US010954932B2

(12) United States Patent
Nguyen

(10) Patent No.: US 10,954,932 B2
(45) Date of Patent: Mar. 23, 2021

(54) ELECTROMAGNETIC COOLING FAN

(71) Applicant: Tung Thanh Nguyen, San Jose, CA (US)

(72) Inventor: Tung Thanh Nguyen, San Jose, CA (US)

( * ) Notice: Subject to any disclaimer, the term of this patent is extended or adjusted under 35 U.S.C. 154(b) by 88 days.

(21) Appl. No.: 16/292,341

(22) Filed: Mar. 5, 2019

(65) Prior Publication Data

US 2020/0284249 A1 Sep. 10, 2020

(51) Int. Cl.
*F04B 45/047* (2006.01)
*F04B 45/04* (2006.01)

(52) U.S. Cl.
CPC ..... *F04B 45/047* (2013.01); *F04B 45/041* (2013.01); *F04B 45/043* (2013.01)

(58) Field of Classification Search
CPC .... F04B 45/047; F04B 45/041; F04B 45/043; F04D 33/00
See application file for complete search history.

(56) References Cited

U.S. PATENT DOCUMENTS

| | | | | |
|---|---|---|---|---|
| 4,063,826 | A * | 12/1977 | Riepe | F04D 33/00 417/410.1 |
| 9,163,624 | B2 * | 10/2015 | Chen | F04D 33/00 |
| 10,184,493 | B2 * | 1/2019 | Nguyen | F04B 43/046 |
| 10,280,945 | B2 * | 5/2019 | Donnelly | F04D 33/00 |
| 2009/0074571 | A1 * | 3/2009 | Jang | F04D 33/00 415/208.1 |
| 2017/0181316 | A1 * | 6/2017 | Su | G06F 1/203 |

* cited by examiner

*Primary Examiner* — Michael C Zarroli

(57) ABSTRACT

An electromagnetic cooling fan includes a thin blade connected to an elongated beam. The beam is simply supported at its two ends with two supporting members. The beam has a magnet attached to it at the center. An electromagnet is used to generate cyclic force on the magnet, causing the beam and the blade to oscillate, generating air flow for cooling purpose.

17 Claims, 5 Drawing Sheets

ELECTROMAGNETIC COOLING FAN

FIELD

The present invention relates to a fan, and more particularly concerns an electromagnetic flapping fan for cooling purpose.

BACKGROUND

Many components in an electronic package such as CPU, GPU, and LED light dissipate significant heat during operation, which causes temperature increase in the package. This may negatively affect user experience, performance and reliability of the package. A rotary fan blowing air across high temperature regions is usually used for cooling purpose. Rotary fans can generate significant air flow. However, they are relatively unreliable due to their bearing system.

Another type of fan is flapping fan, which typically includes an elongated cantilever blade attached to an actuator. Flapping fans can be driven by either piezo actuators (as seen in, for example, U.S. Pat. Nos. 4,595,338, 4,780,062, 4,923,000, 5,861,703, 7,061,161, 7,642,698, U.S. 20020175596 A1, U.S. 2007/0090726 A1, U.S. 2011/0120679 A1, U.S. 2011/0014069 A1, U.S. Pat. Nos. 8,322,889, and 8,581,471) or electromagnetic ones (as seen in, for example, U.S. Pat. No. 6,043,978 A, U.S. 2016/0320812 A1, U.S. 2017/0181316 A1). Since flapping fans include no moving parts, they are very reliable. Unfortunately, aerodynamic efficiency of the fans is usually low. They generate very little net air flow, which greatly limits their applications.

Accordingly, the need still exists for a fan that is reliable, efficient, and able to generate significant net air flow for cooling purpose.

SUMMARY

This invention relates to an electromagnetic flapping fan which includes a thin elongated beam supported at its ends with rubber living hinges and supporting members. A thin blade is connected to the central portion of the beam through two connecting members. The beam has a magnet (or an electromagnet) at its center. Another magnet is arranged apart from the magnet on the beam. AC signal is applied to one of the magnets to generate varying magnetic field, which induces cyclic force on the beam. This causes the beam and the blade to oscillate around their neutral positions, generating air flow.

There is no bearing, no mechanical friction in this fan, allowing it to have high reliability and high efficiency. The simple structure makes it easy to manufacture. The fan can be conveniently miniaturized and tailored to have suitable form factor for different applications such as LED lighting, telecommunication, and data center.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION

The present invention will now be described in full details with reference to the accompanying drawings in which example embodiments of the claimed invention are shown.

First Embodiment

Figure 1A:
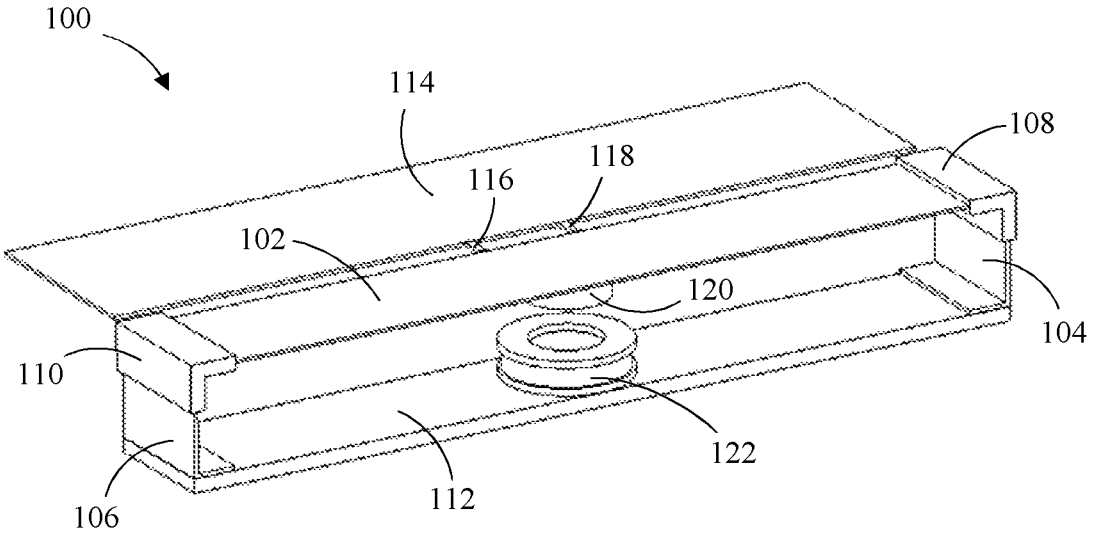
FIG. 1A is a perspective view of a first embodiment of an electromagnetic cooling fan according to this invention.
Figure 1B:
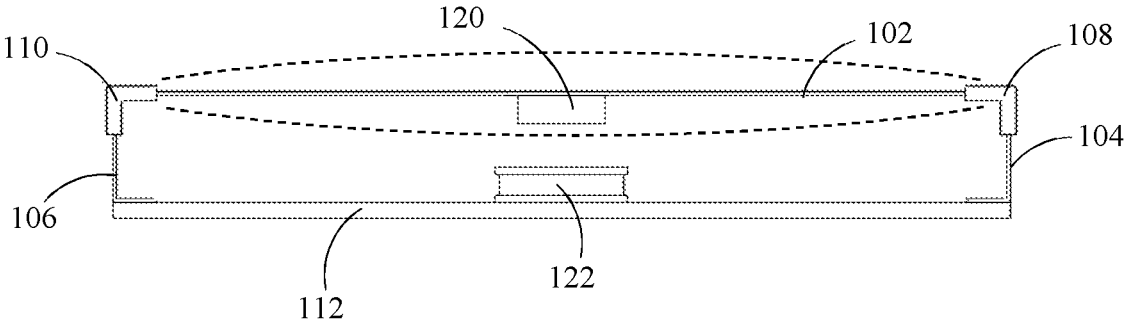
FIG. 1B is a front view of the electromagnetic cooling fan of FIG. 1A.
Figure 1C:
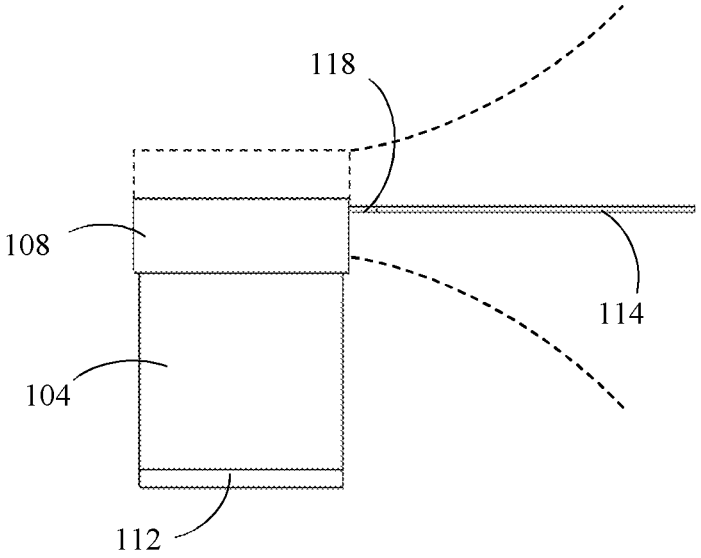
FIG. 1C is a side view of the electromagnetic cooling fan of FIG. 1A.

Referring to FIGS. 1A, 1B, and 1C, an electromagnetic cooling fan according to a first embodiment of this invention is provided. In this embodiment, the fan 100 includes a thin elongated beam 102. Two ends of the beam 102 are attached to two supporting members 104, 106, which are arranged perpendicular to the beam 102, through two connecting members 108, 110. The beam 102 can be made of a durable material such as steel or carbon fiber. Connecting members 108, 110 act as living hinges between the beam 102 and the supporting members 104, 106. This simply supported boundary condition allows the beam 102 to have maximum deflection. The connecting members 108, 110 can be made of an elastomer material such as silicone or polyurethane rubber using liquid rubber overmolding technique. The supporting members 104, 106 are attached to a base 112, which is arranged to remain stationary. A thin blade 114 is arranged parallel to the beam 102. They are connected to each other through two identical connecting members 116, 118 located near the central portion of the fan 100. The blade 114 can be made as a lightweight composite structure, which consists of a carbon fiber frame and a thin durable fabric membrane (such as polyester, nylon, or silk) attached to the frame (not shown). The beam 102 includes a cylinder-shaped magnet 120 at its center. The magnet 120 can be either a permanent rare-earth magnet or a DC electromagnet, which can generate a fixed magnetic field. An electromagnet 122, which typically consists of copper wire wound into a coil, is arranged apart from the magnet 120. The central axes of the magnet 120 and the electromagnet 122 should be aligned. An iron core may be added at the center of the coil to make the electromagnet more powerful. The electromagnet 122 is fixed to the base 112.

When an AC signal is applied to the electromagnet 122, a varying magnetic field is generated. The magnetic field induces cyclic force on the magnet 120, causing the beam 102 and the blade 114 to oscillate around their neutral positions, generating air flow which can be used for cooling purpose. Dotted lines in FIGS. 1B and 1C illustrate the oscillation of the beam 102 and the blade 114. The frequency of the AC signal should be close to the first resonant frequency of the beam 102 for maximum performance.

It is noted that the positions of the magnet 120 and the electromagnet 122 can be switched without affecting the working principle of the fan 100. The magnet 120 can be attached to the base 112, while the electromagnet 122 can be attached to the beam 102. Furthermore, more than one set of magnet and electromagnet can be used to increase the fan performance.

Second Embodiment

Figure 2A:
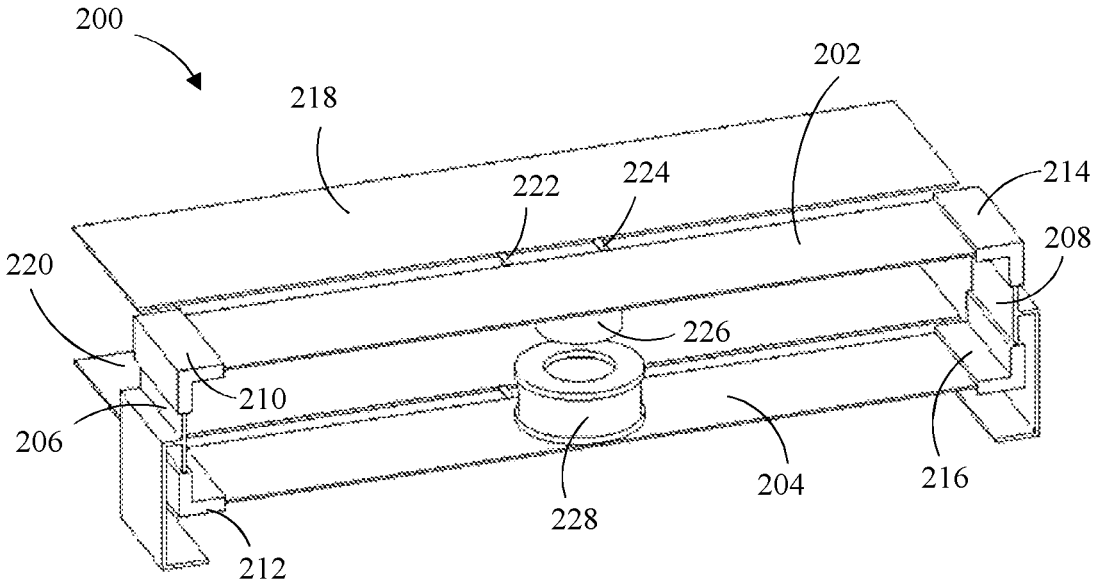
FIG. 2A is a perspective view of a second embodiment of an electromagnetic cooling fan according to this invention.
Figure 2B:
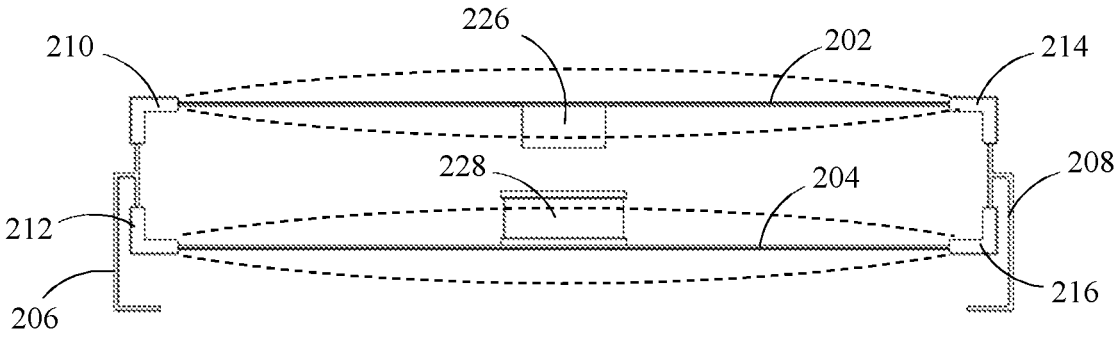
FIG. 2B is a front view of the electromagnetic cooling fan of FIG. 2A.

Referring to FIGS. 2A and 2B, an electromagnetic cooling fan according to a second embodiment of this invention is provided. In this embodiment, two fans of the first embodiment are combined to form a double blade flapping fan 200. The fan 200 includes two identical elongated beams 202, 204 arranged parallel to each other. The ends of the beams 202, 204 are connected to two supporting members 206, 208, through four living hinges 210, 212, 214, 216. Two thin identical blades 218, 220 are arranged parallel to the two beams 202, 204. Each blade is connected to the beam through two connecting members 222, 224. The beam 202 includes a magnet 226 at its center. The magnet 226 can be either a permanent rare-earth magnet or a DC electromagnet. An electromagnet 228 is disposed at the center of the beam 204. When an AC signal is applied to the electromagnet 228, a varying magnetic field is generated. The magnetic field induces cyclic forces between the magnet 226 and the electromagnet 228, causing the beams 202, 204 and the blades 218, 220 to oscillate around their neutral positions, as illustrated in FIG. 2B, generating air flow. The magnet 226 and the electromagnet 228 should have the same mass, so that the first resonant frequencies of the beams 202, 204 are the same. The frequency of the AC signal should be close to the first resonant frequency of the beams 202, 204 for maximum performance.

Third Embodiment

Figure 3A:
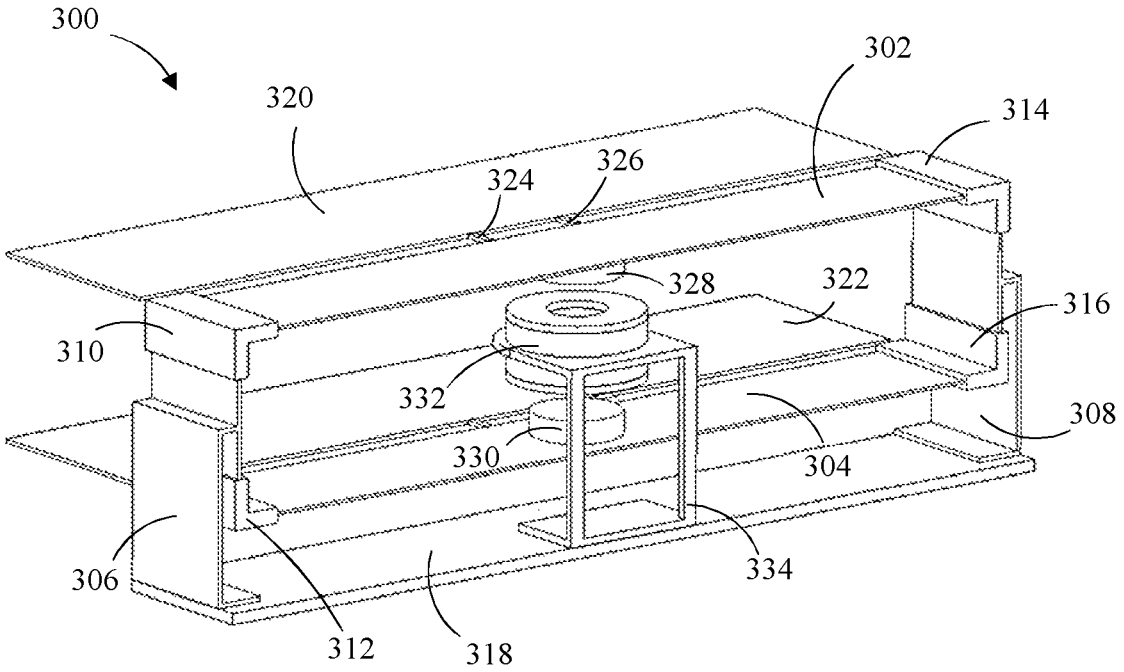
FIG. 3A is a perspective view of a third embodiment of an electromagnetic cooling fan according to this invention.
Figure 3B:
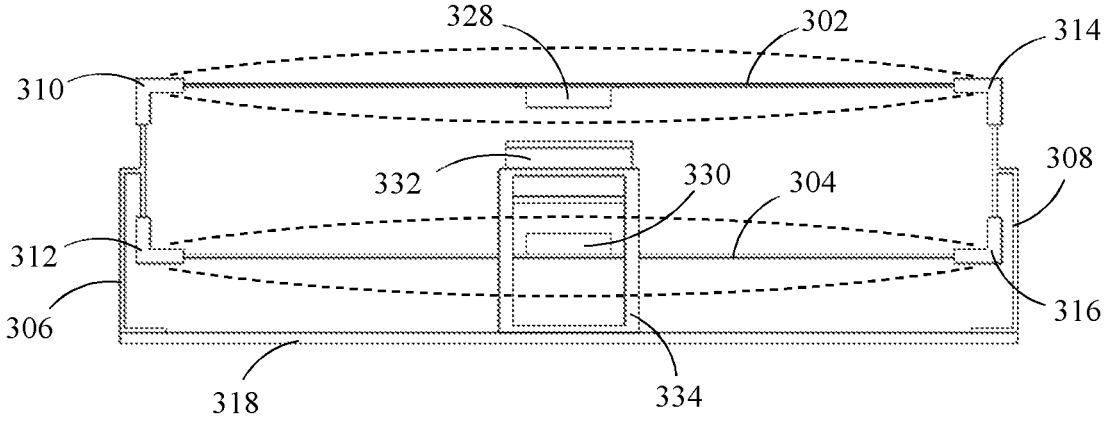
FIG. 3B is a front view of the electromagnetic cooling fan of FIG. 3A.

Referring to FIGS. 3A and 3B, an electromagnetic cooling fan according to a third embodiment of this invention is provided. In this embodiment, two flapping fans of the first embodiment are arranged in parallel to form a double blade flapping fan 300. The fan 300 includes two identical elongated beams 302, 304 arranged parallel to each other. The ends of the beams 302, 304 are connected to two supporting members 306, 308, through four living hinges 310, 312, 314, 316. The supporting members 306, 308 are fixed to a base 318, which is arranged to remain stationary. Two thin identical blades 320, 322 are arranged parallel to the two beams 302, 304. Each blade is connected to the beam through connecting members 324, 326. Each beam 302, 304 includes a magnet 328, 330 at its center. The magnets 328, 330 can be either permanent rare-earth magnets or DC electromagnets. An electromagnet 332 is arranged between the two magnets 328, 330. The electromagnet 332 is attached to the base 318 through a supporting frame 334.

When an AC signal is applied to the electromagnet 332, a varying magnetic field is generated. The magnetic field induces cyclic forces between the magnets 328, 330 and the electromagnet 332, causing the beams 302, 304 and the blades 320, 322 to oscillate, as illustrated in FIG. 3B, generating air flow. The magnets 328, 330 should have the same mass, so that the first resonant frequencies of the beams 302, 304 are the same. The frequency of the AC signal should be close to the first resonant frequency of the beams 302, 304 for maximum performance. The two magnets 328, 330 should be configured to be mutually attractive, so that the two forces that the electromagnet 332 induces on the magnets 328, 330 are opposite, and thus, canceling out each other. This helps to minimize vibration of the base 318 during operation.

Fourth Embodiment

Figure 4A:
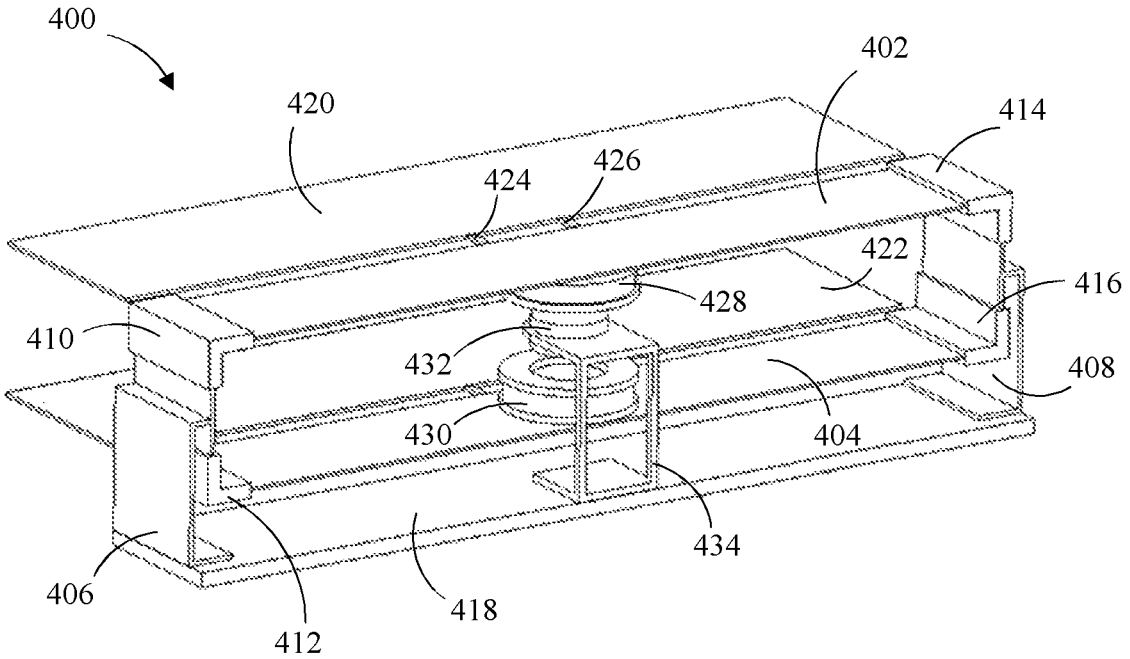
FIG. 4A is a perspective view of a fourth embodiment of an electromagnetic cooling fan according to this invention.
Figure 4B:
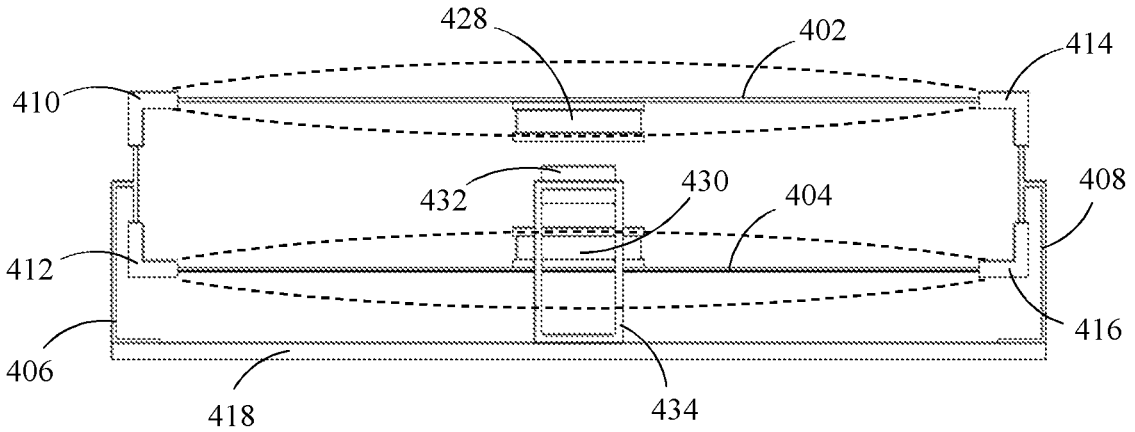
FIG. 4B is a front view of the electromagnetic cooling fan of FIG. 4A.

Referring to FIGS. 4A and 4B, an electromagnetic cooling fan according to a fourth embodiment of this invention is provided. In this embodiment, two flapping fans of the first embodiment are arranged in parallel to form a double blade flapping fan 400. The fan 400 includes two identical elongated beams 402, 404 arranged parallel to each other. The ends of the beams 402, 404 are connected to two supporting members 406, 408, through four living hinges 410, 412, 414, 416. The supporting members 406, 408 are fixed to a base 418, which is arranged to remain stationary. Two thin identical blades 420, 422 are arranged parallel to the two beams 402, 404. Each blade is connected to the beam through two connecting members 424, 426. Each beam 402, 404 includes an electromagnet 428, 430 at its center. A magnet 432 is arranged between the two electromagnets 428, 430. The magnet 432 can be either a permanent rare-earth magnet or a DC electromagnet. The magnet 432 is attached to the base 418 through a supporting frame 434. When an AC signal is applied to the electromagnets 428, 430 varying magnetic fields are generated. The magnetic fields induce cyclic forces between the electromagnets 428, 430 and the magnet 432, causing the beams 402, 404 and the blades 420, 422 to oscillate, as illustrated in FIG. 4B, generating air flow. The electromagnets 428, 430 should have the same mass, so that the first resonant frequencies of the beams 402, 404 are the same. The frequency of the AC signal should be close to the first resonant frequency of the beams 402, 404 for maximum performance. The two electromagnets 428, 430 should be configured to be mutually attractive, so that the two forces that the magnet 432 induces on the electromagnets 428, 430 are opposite, and thus, canceling out each other. This helps to minimize vibration of the base 418 during operation.

The fan can be used in a conjunction with a heat sink to form a cooling device. Unlike rotary fans, the flapping fan of this invention includes only a few simple parts, making it easy to manufacture. The fan has no bearing (and thus no friction energy loss), making it reliable and efficient. Furthermore, the fan can be conveniently miniaturized and tailored to have suitable form factors for different applications such as LED lighting, telecommunication, and data center.

Since other modifications and changes in the material, shape, size, number of the parts, and arrangement of the parts will be apparent to those skilled in the art, it has to be understood that the invention is not considered limited to the above described embodiments of this invention, and covers all changes and modifications which do not constitute departures from the true spirit and scope of this invention.

What is claimed is:

1. A flapping fan; comprising:

a thin elongated beam;

a first magnet attached to said beam;

two supporting members arranged substantially perpendicular to said beam, each said supporting member is attached to each end of said beam;

a thin blade arranged parallel to said beam;

at least a connecting member mechanically connecting the leading edge of said blade to the central portion of said beam; and a second magnet arranged apart from said first magnet;

whereby when activated by an AC signal, one of said magnet generates a varying magnetic field, the magnetic field induces cyclic force between the first and the second magnets, causing the beam and the blade to oscillate around their inactive positions, generating air flow.

2. The flapping fan of claim 1, wherein said supporting members are attached to said beam using two silicone rubber living hinges.

3. The flapping fan of claim 1, wherein said blade is made of polyester fabric with a carbon fiber frame.

4. The flapping fan of claim 1, wherein said beam is made of carbon fiber composite.

5. The flapping fan of claim 1, wherein said first magnet is a cylinder-shaped permanent rare earth one.

6. The flapping fan of claim 5, wherein said second magnet is an electromagnet.

7. The flapping fan of claim 6, wherein said electromagnet includes copper wire wound around an iron core.

8. The flapping fan of claim 7, wherein said electromagnet is activated by an AC sinusoidal signal near the first resonant frequency of said beam.

9. The flapping fan of claim 1, wherein said first magnet is an electromagnet.

10. The flapping fan of claim 9, wherein said second magnet is a permanent rare earth one.

11. The flapping fan of claim 1, wherein said first magnet is an electromagnet.

12. The flapping fan of claim 11, wherein said second magnet is an electromagnet.

13. The flapping fan of claim 1, wherein said second magnet is configurated to remain stationary.

14. The flapping fan of claim 1, wherein said second magnet is attached to a second beam identical to said first beam.

15. The flapping fan of claim 14, wherein each end of said second beam is attached to said supporting members.

16. The flapping fan of claim 15, wherein said second beam is connected to a second thin blade identical to said first blade.

17. The flapping fan of claim 16, wherein said first magnet and said second magnet have the same mass.

* * * * *